US008872710B2

(12) United States Patent
Wallace

(10) Patent No.: US 8,872,710 B2
(45) Date of Patent: Oct. 28, 2014

(54) ENCLOSED BACK SIDE HEATING SYSTEM FOR SATELLITE DISHES

(76) Inventor: Robert Blair Wallace, Kelowna (CA)

( * ) Notice: Subject to any disclaimer, the term of this patent is extended or adjusted under 35 U.S.C. 154(b) by 280 days.

(21) Appl. No.: 13/559,366

(22) Filed: Jul. 26, 2012

(65) Prior Publication Data

US 2014/0028506 A1 Jan. 30, 2014

(51) Int. Cl.
*H01Q 1/02* (2006.01)
*H01Q 19/12* (2006.01)

(52) U.S. Cl.
CPC . *H01Q 1/02* (2013.01); *H01Q 19/12* (2013.01)
USPC ..... 343/704; 343/878; 343/912

(58) Field of Classification Search
CPC ..... H01Q 19/12; H01Q 1/02
USPC ..... 343/704, 713, 878, 912, 872, 916
See application file for complete search history.

(56) References Cited

U.S. PATENT DOCUMENTS

| | | | | |
|---|---|---|---|---|
| 4,368,471 | A * | 1/1983 | Walton, Jr. | 343/704 |
| 4,866,452 | A | 9/1989 | Barma et al. | |
| 5,920,289 | A | 7/1999 | Jones | |
| 5,942,140 | A * | 8/1999 | Miller et al. | 219/213 |
| 5,963,171 | A | 10/1999 | Jones | |
| 6,195,056 | B1 * | 2/2001 | Jones | 343/704 |
| 7,508,351 | B2 * | 3/2009 | Greenleaf et al. | 343/872 |
| 8,305,278 | B2 * | 11/2012 | Corn | 343/704 |
| 2010/0295742 | A1 | 11/2010 | Corn | |

OTHER PUBLICATIONS http://www.thesatelliteshop.net/satelltie-dish -heaters-c-871.html.

* cited by examiner

*Primary Examiner* — Hoanganh Le
(74) *Attorney, Agent, or Firm* — Antony C. Edwards

(57) ABSTRACT

A satellite dish heating system is installed on the rear side of a residential or commercial satellite dish to generate enough heat to keep the front face of a satellite dish reflector and the extension arm leading to the Lnbf warm enough to defrost the dish and arm during winter weather conditions including snow, ice, frost and ice fog, which interfere with satellite dish reception.

17 Claims, 5 Drawing Sheets

ENCLOSED BACK SIDE HEATING SYSTEM FOR SATELLITE DISHES

FIELD OF THE INVENTION

This invention relates to the field of satellite dish receivers used in satellite transmission systems, and in particular, to a heating system for heating the back side of such satellite dishes so as to melt snow and ice accumulated in the dish.

BACKGROUND OF THE INVENTION

Residential or commercial satellite dishes are commonly attached to residential homes and commercial buildings and are used to capture frequencies transmitted from communication satellite orbiting the earth to subscriber residential and commercial customers.

In areas where winter weather conditions occur, snow, ice, heavy frost and ice fog can collect on the front of a residential or commercial satellite dish and cause the signals being captured by the dish to become disrupted. Temperatures in some areas may reach −30 degrees Celsius or below which make clearing the dish face quite challenging due to exposure issues. Once the build up of snow, ice, frost or ice fog becomes heavy enough, the signal the satellite dish is receiving can become disrupted so as to not allow the electronic equipment connected to the lines leading from the satellite dish to function properly. Thus, the subscribed residential or commercial satellite television programming will no longer broadcast to the customer until the snow, ice, frost or ice fog is removed. Winter weather related outages can occur multiple times throughout a winter season.

Unfortunately, due to nature of residential or commercial satellite dishes having to maintain peak signals, they are often installed at the high points of homes or commercial buildings, on the rooftops of homes or commercial building or in locations that are sometime inaccessible during winter conditions. Thus customers are often left without satellite signal and programming for days at a time.

The costs related to the snow, ice, frost and ice fog related outages are frustrating for the customers of the satellite service providers and cost the satellite service providers valuable revenue when having to compensate the customers. As well, these outages are costly to the satellite service providers due to the fact that a technician has to be dispatched out to a customer's residential home or commercial building in order to remove the snow, ice, frost or ice fog to thereby restore proper satellite signal and programming. Depending on the circumstances, the winter weather related service calls cost the satellite service providers hundreds of dollars each time they are dispatched.

During severe winter storms, extreme accumulations of snowfall, ice, frost or ice fog may occur throughout a day. Thus during storms lasting days the satellite dish on a residential home or commercial building may need to be cleared multiple times in order to restore signal and programming. This compounds the unsafe nature of having to restore the signal to the satellite dish.

As stated by Jones in U.S. Pat. No. 5,920,289, which issued Jul. 6, 1999 for a Heated Satellite Reflector Assembly, reflector, commonly called a dish, is generally a parabolic section having a round or elliptical configuration. A reflector functions to gather radio or microwave frequency energy transmitted from the feedhorn or through the ambient environment from an external transmitter. The reflector can thus be used to receive and transmit signals to and from the satellite system.

Reflectors are usually located outdoors, where snow and ice may collect on the receiving or concave side, degrading the performance of the reflector.

It is known to heat the front surface of a reflector with an embedded heater wire.

It is also known to mold heater wire into the back side of the reflector. That is, the heater wire is molded into the reflector closer to the back surface of the reflector than to the front surface. Additionally, it is known to embed heating electrodes within a reflector. As with other known reflector assemblies employing embedded heaters, no insulation is provided on the back of the reflector to inhibit heat transfer to the ambient environment.

It is further known to provide a reflector assembly with a reflector which is spaced apart from and connected with a back cover. The reflector and back cover define an enclosed air chamber therebetween. A radiant heater is placed within the air chamber adjacent the back cover and radiates heat to the entire back surface of the reflector to melt or inhibit the accumulation of ice and snow on the reflector. Alternatively, forced hot air may be circulated within the air chamber between the reflector and back cover. The inside surface of the back cover may include a layer of fiberglass insulation and/or a reflective surface to radiate heat towards the reflector.

A reflector assembly used in conjunction with a back cover uses convection or radiation to heat the back surface of the reflector. Such a heating technique is effective to heat the entire back surface of the reflector when desirable for certain applications, but is somewhat inefficient since the back surface of the reflector must be heated via convection or radiation and the heat then transferred to the front surface of the reflector via conduction. This means that the back surface of the reflector must actually be heated above a desired operating temperature on the front surface of the reflector due to thermal losses resulting from the conduction heat transfer. Moreover, the back cover is spaced apart from the reflector and increases the effective size of the reflector assembly, requiring additional space for operation and rendering handling more cumbersome.

Jones discloses embedding heater wire under the front surface of a satellite dish reflector, wherein the heater wire is separated from the back surface of the reflector by a layer of thermal insulation. The heater is placed adjacent to the reflecting surface of the antenna.

Jones, in U.S. Pat. No. 5,963,171 which issued Oct. 5, 1999, for a Thermally Insulated Satellite Reflector Assembly With Non-embedded Heater Assembly, discloses the use of foam insulation mounted to the ribs of the back surface of a satellite dish reflector assembly wherein a heater assembly is attached to the inside surface of the foam insulation.

In the prior art applicant is also aware of published United States patent application filed by Corn and published Nov. 25, 2010 under publication no. US 2010/0295742, and entitled Satellite Dish Heating System, wherein Corn describes using a single piece of circular notched vinyl thermoplastic sheet having a shape corresponding to the shape of a satellite dish wherein a dual-wire heater cable is adhesively applied to the rear surface of the dish.

Applicant is also aware of U.S. Pat. No. 4,866,452 which issued Sep. 12, 1989, to Barma for Heated Dish Antennas, wherein Barma discloses using a radiant heater located behind the dish antenna and spaced apart therefrom wherein a back shell is mounted behind the ribs of the dish antenna, and wherein a layer of insulation is mounted to the inside surface of the back shell and heater panels are mounted to the inside surface of the insulation. Barma teaches that typically the distance between the heater and the back surface of the dish antenna is three-six inches.

In the prior art of which applicant is also aware the Hot-Shot™ dish heating system is applied to the front face of a satellite dish reflector, which covers up the branding for the satellite company, and relies on an adhesive for mounting the heating element to the front face of the dish. The Ice Zapper™ satellite dish heating system is strictly used for heating round, metal satellite dishes. 2×3"×10" strips of heat trace that are applied to the rear of a metal satellite dish. The system relies on the heat transfer of the heat through the metal to distribute the heat around the dish. The heat strips are applied with adhesives.

SUMMARY OF THE INVENTION

In summary, in one aspect of the present invention, the satellite dish heating system, and method for mounting same, may be characterized as for mounting between:

(a) a satellite dish having a concave front surface and an opposite convex rear surface, wherein the rear surface of the dish has a substantially centrally positioned mounting platform extending rearwardly therefrom, and wherein the mounting platform has mounting bores therein spaced apart around the platform; and, (b) a mounting bracket for rigidly mounting the dish to a secure mounting location on a roof, house, or building, etcetera wherein the mounting bracket has at least one mounting face adapted for mounting onto the mounting platform, and the one mounting face or faces have mounting apertures therein, positioned for mounting registry between the bores on the mounting platform and the apertures in the mounting face or faces when the mounting bracket is adjacent the mounting platform so as to accept fasteners such as bolts journalled through the bores and corresponding apertures to thereby mount the mounting bracket to the dish, wherein the satellite dish heating system in one embodiment includes a cover having a rim therearound sized to snugly mate onto and around, so as to seal from the exterior environment, a corresponding circumferential outer edge of the dish. The cover when mounted thereon defines an interior cavity. The cover has at least one hole therethrough which is also substantially centrally positioned so that the cover is sandwiched between the mounting platform on the rear surface of the dish and the mounting bracket when mounted onto the mounting platform. The cover has an inner surface in opposed facing relation to the rear surface of the dish when the cover is mounted on the dish. A layer of insulation is mounted within the cavity adjacent the inner surface of the cover. At least one heating element is mounted within the cavity adjacent the layer of insulation and on an opposite side of the layer of insulation from the inner surface of the cover, whereby at least one heating element is mounted between the layer of insulation and the rear surface of the dish.

In a preferred embodiment the layer of insulation is mounted against the inner surface of the cover and the heating element is mounted against the layer of insulation. The layer of insulation and the heating element may extend within the cover between and substantially to opposite sides of the cover's rim. Advantageously the cover is sized so that, with the layer of insulation and the heating element mounted within the cover, the cavity includes an air-space between the heating element and the rear surface of the dish.

In one embodiment the heating element includes at least one heating tape, and the layer of insulation includes a reflective layer such a metal reflective layer, which is reflective of thermal radiation from the heating element. The layer of insulation may advantageously include insulating material and the reflective layer may advantageously be positioned between the heating element and the insulating material. The system may further comprise a heat conductive plate mounted adjacent the heating element so as to be between the rear surface of the dish and the heating element when the cover is mounted on the dish.

In the illustrated embodiment, which is not intended to be limiting, the mounting platform is substantially a collar, and wherein the at least one hole in the cover includes a central hole substantially corresponding in size and position to the collar, and wherein the central hole is slightly smaller in diameter as compared to a diameter of the collar and as compared to a corresponding diameter of the mounting face on the mounting bracket. Thus a circumferential rim of the central hole is pinched between the mounting platform and the mounting face when the cover is mounted to the back or rear side of the reflector dish.

The present invention may also be characterized in one aspect as a method for heating a satellite dish comprising:

a) providing a satellite dish having a concave front surface and an opposite convex rear surface, wherein the rear surface of the dish has a substantially centrally positioned mounting platform extending rearwardly therefrom, the mounting platform having mounting bores therein spaced apart around the platform; and, b) providing a mounting bracket for rigidly mounting the dish to a secure mounting location on a roof, house, building, wherein the mounting bracket has at least one mounting face adapted for mounting onto the mounting platform, the at least one mounting face having mounting apertures therein, positioned for mounting registry between the bores and the apertures when the mounting bracket is adjacent the mounting platform so as to accept fasteners journalled through the bores and corresponding the apertures to thereby mount the mounting bracket to the dish, c) providing a cover having a rim therearound sized to snugly mate onto and around, so as to seal from the exterior environment, a corresponding circumferential outer edge of the dish, the cover when mounted thereon defining an interior cavity, the cover having at least one hole therethrough the substantially centrally positioned so that the cover is sandwiched or pinch-mounted between the mounting platform on the rear surface of the dish and the mounting bracket when mounted onto the mounting platform, the cover having an inner surface in opposed facing relation to the rear surface of the dish when the cover is mounted on the dish.

Wherein a layer of insulation is mounted within the cavity adjacent the inner surface of the cover, and wherein at least one heating element is mounted within the cavity adjacent the layer of insulation and on an opposite side of the layer of insulation from the inner surface of the cover whereby the at least one heating element is mounted between the layer of insulation and the rear surface of the dish, d) mounting the cover onto the dish so as to snugly mount the rim of the cover around the cover and so as to align the mounting platform within the at least one hole in the cover, e) mounting the mounting face of the mounting bracket onto the mounting platform on the rear surface of the dish so as to pinch-mount the cover in a friction mounting therebetween.

DETAILED DESCRIPTION OF EMBODIMENTS OF THE INVENTION

Figure 1:
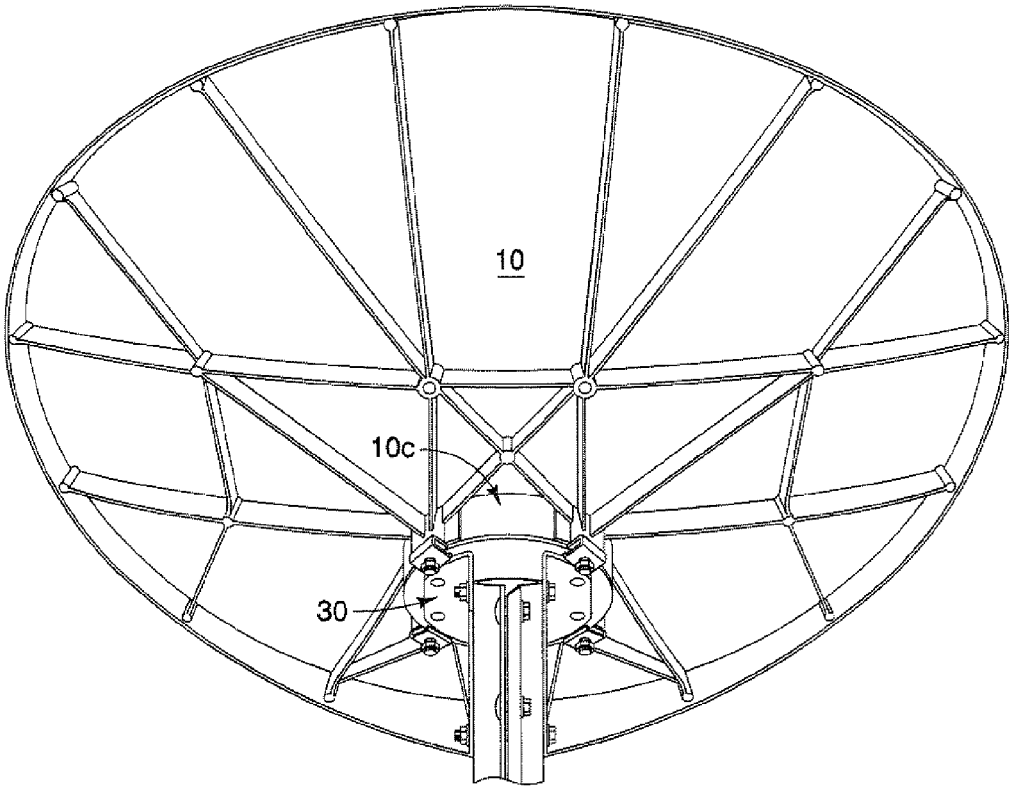
FIG. 1 is, in rear perspective view, the rear surface of a conventional satellite dish and its mounting bracket.
Figure 2:
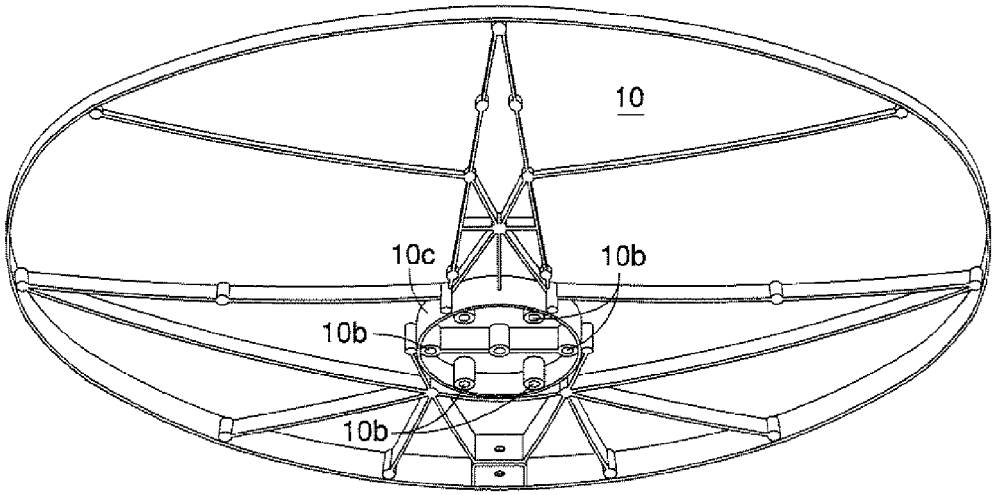
FIG. 2 is the view of FIG. 1 with the mounting bracket removed so as to show the centrally located mounting platform, in the form of a mounting collar, on the rear surface of the satellite dish.
Figure 3:
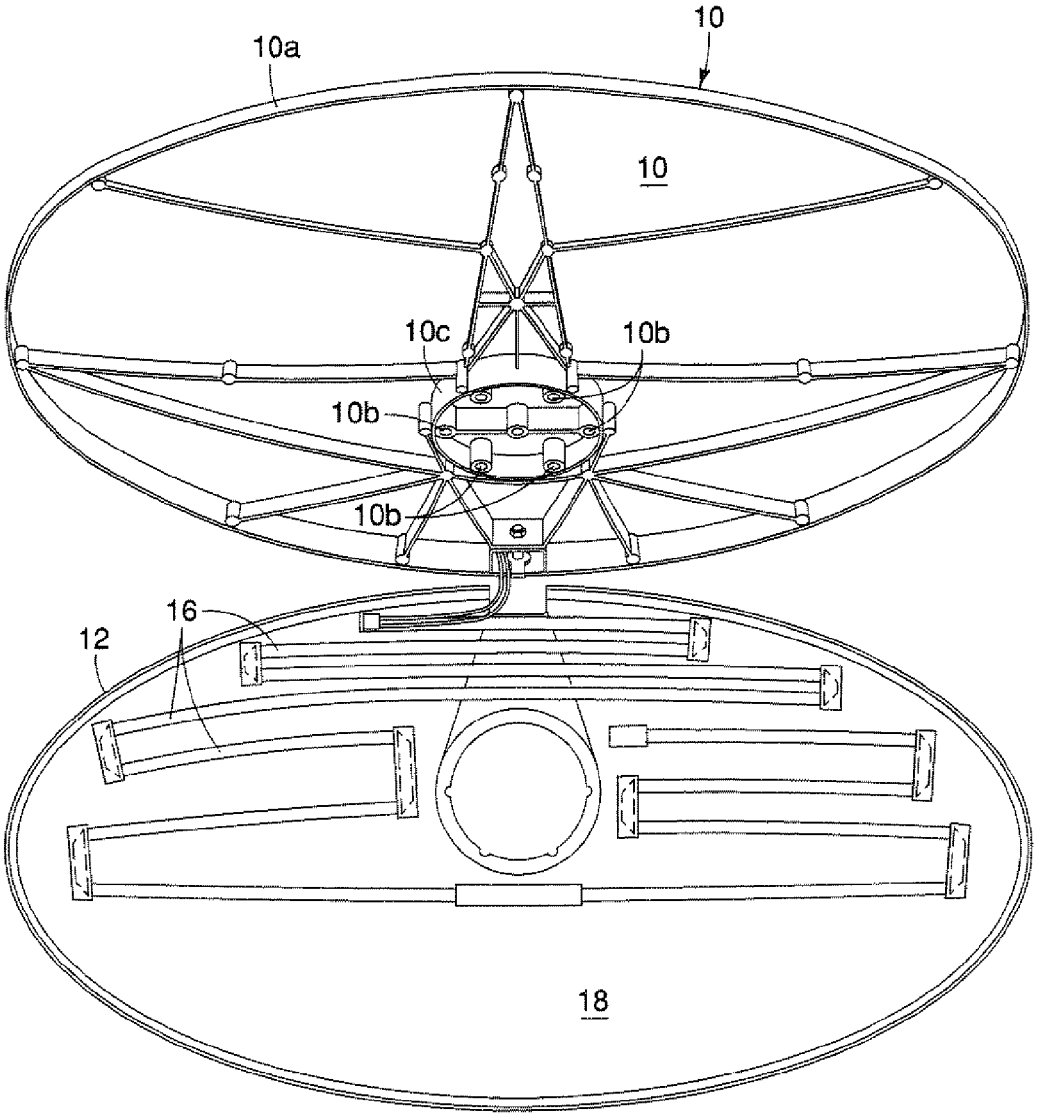
FIG. 3 is, in rear, partially exploded, perspective view, showing the inside surface of the back cover containing the layer of insulation and the heating element, aligned with, for mounting onto, the rear surface of the satellite dish of FIG. 2.
Figure 4:
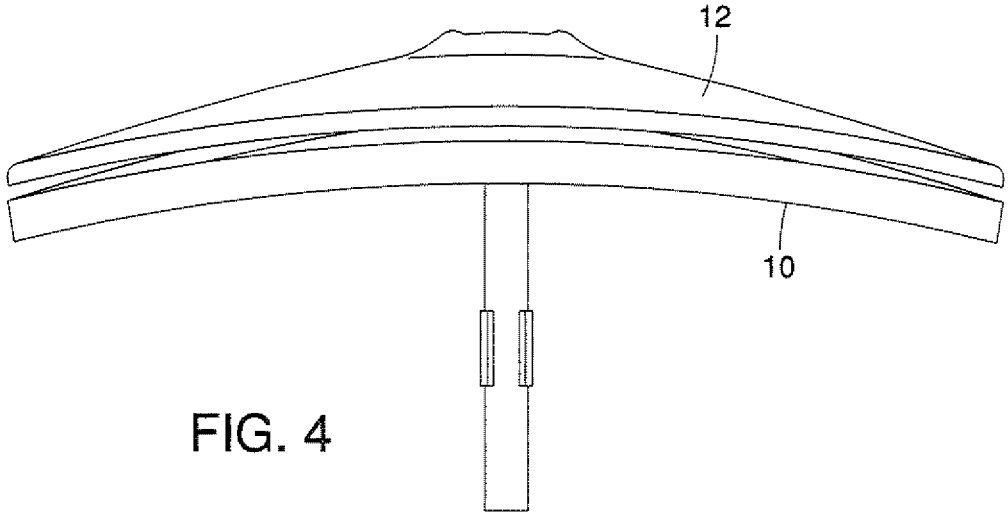
FIG. 4 is, in partially exploded elevation view, the satellite dish of FIG. 3 with the rear cover position for mounting onto the rear surface of the satellite dish.
Figure 5:
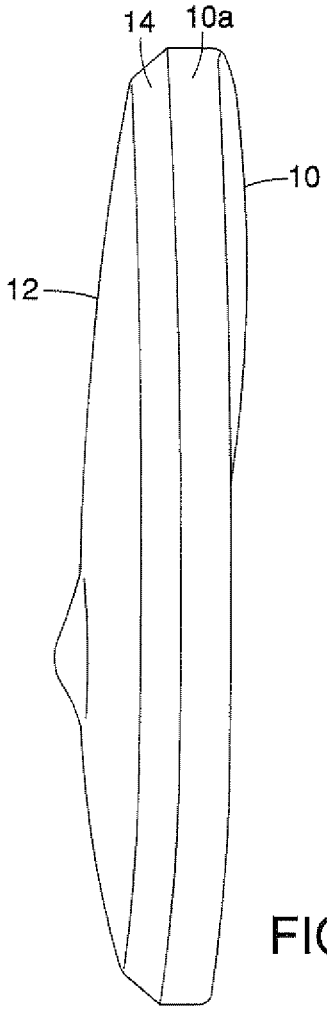
FIG. 5, is in side elevation view, the satellite dish of FIG. 4 with the back cover mounted thereon.
Figure 6:
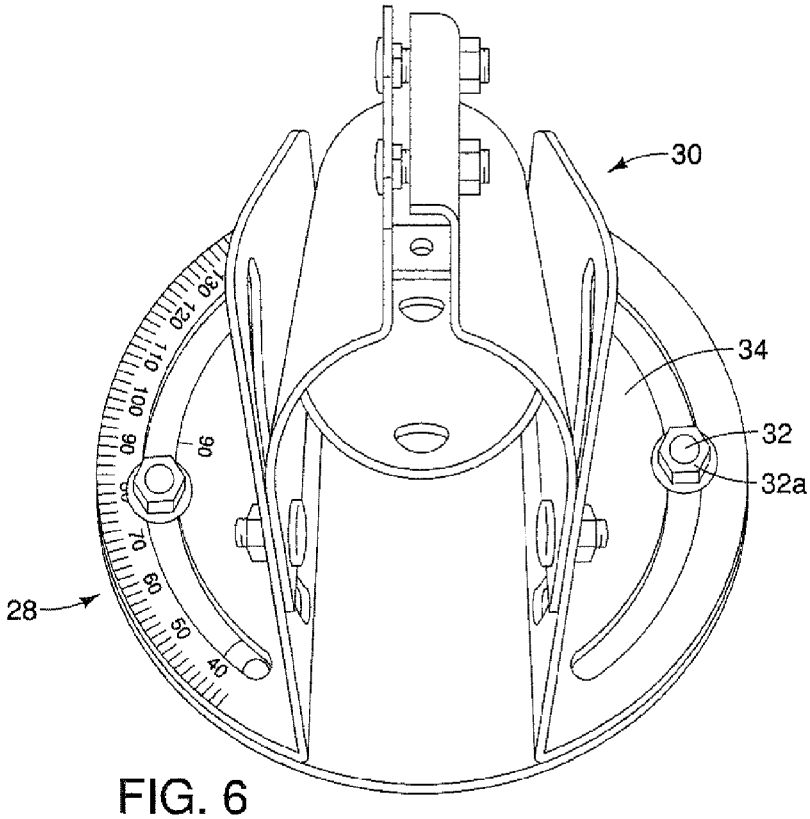
FIG. 6 is, in perspective view, the mounting bracket of FIG. 1.
Figure 7:
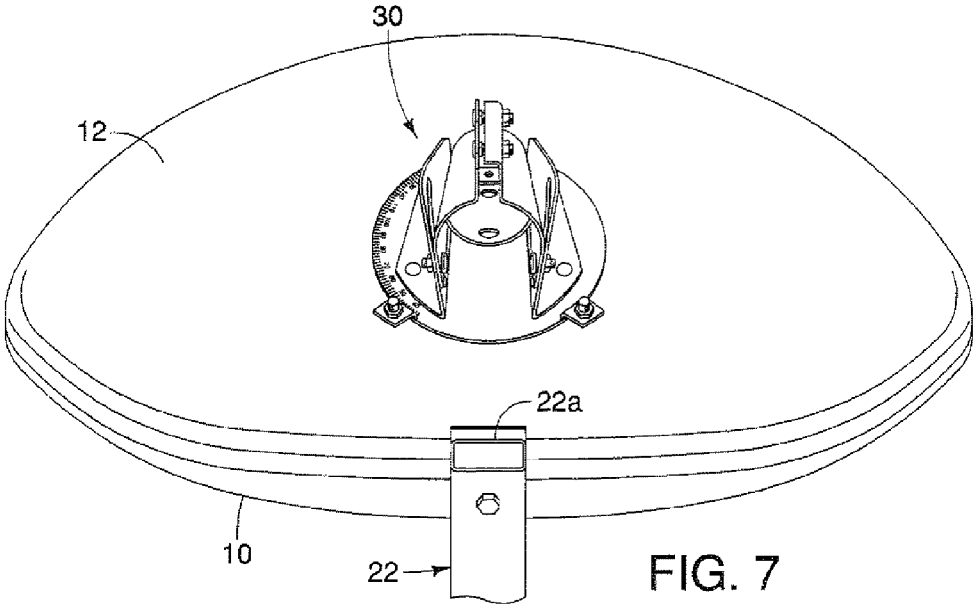
FIG. 7 is, in rear bottom perspective view, the satellite dish of FIG. 4 with the back cover mounted thereon and secured in place by the mounting bracket.

As seen in the accompanying drawing figures wherein similar reference characters denote corresponding parts in each view, the satellite dish heating system according to one embodiment of the present invention may include a plastic rear or back cover 12 attached to the rear of a satellite dish 10. Edge gasket 14 is mounted around the inside outer edge of cover 12 so as to snugly touch the outside of the outer edge 10*a* of dish 10. Gasket 14 minimizes heat loss from between dish 10 and cover 12.

A heating element such as heat tape 16 is mounted to the heat reflective side 18*a* of a sheet of reflective insulation 18. A heat probe 20 is slid into the rear of hollow metal mounting arm 22. Probe 20 keeps snow, ice and frost from forming on arm 22. Satellite dish 10 is mounted on end 22*a* of arm 22.

Figure 8:
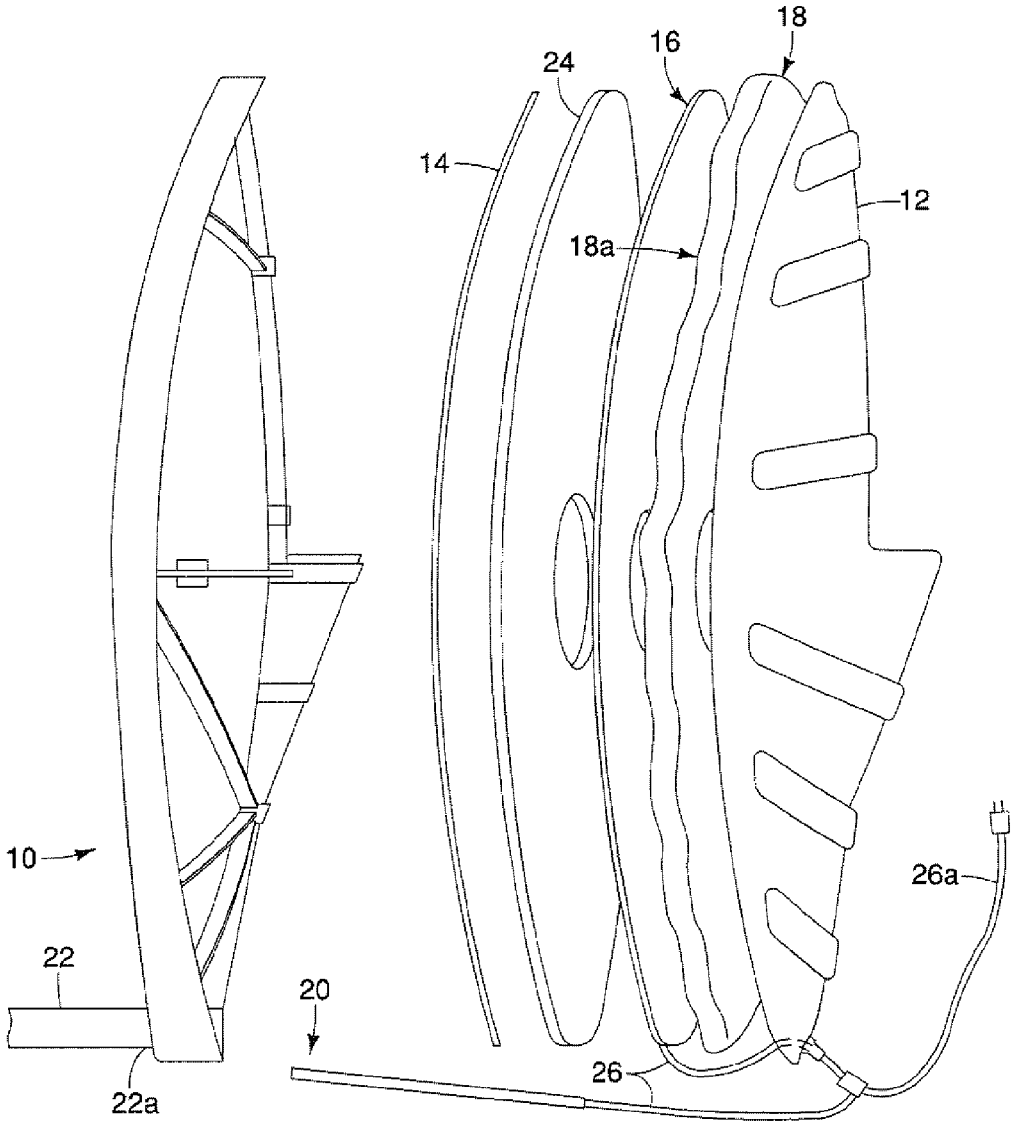
FIG. 8 is, in partially exploded side elevation, a further embodiment of the dish heating system.

In a preferred embodiment such as seen in FIG. 8, an aluminum heat plate 24 is mounted internally for example between the heating element and the rear of dish 10, to disperse the heat more evenly to dish 10. Heat plate 24 may also be made of other heat conductive metals or other materials which conduct and disperse heat energy.

In a preferred embodiment a wireless On/Off switch is provided and the electrical wiring 26 and corresponding electrical cord 26*a* is for example 6 feet long. The user supplies an extension power cord to merely plug in the heating element, and the wireless remotely controlled on/off switch allows the user to conserve energy by not having a thermostat or the like automatically turn the heat on based on temperature and/or moisture. In alternative embodiments a thermostat 26*b* is mounted on wiring 26 or cord 26*a* to control the operation of the heating element.

The reflective insulation 18 reflects heat reflective from the inside rear surface of rear cover 12 in order to radiate the heat into plate 24 and to thereby distribute the heat towards and across the rear surface of dish 10. Heat tape 16 may be mounted, for example by gluing, directly onto the reflective surface 18*a* of insulation 18. Wiring 26 is attached so as to provide power to heat tape 16 and heat probe 20 and leads outside from cover 12 to cord 26*a*. Cord 26*a*, or cord 26*a* extended by an extension power cord (not shown) connects to a mains electrical outlet (not shown).

The mounting bracket of a residential or commercial satellite dish is the device that is used to set all the coordinates of a satellite dish in order for the proper frequencies to be received. All satellite dish mounting brackets attach to the reflector from the rear. Bolts are passed through the front of the satellite dish, through holes in the mounting bracket and then nuts are attached and tightened in order to hold the reflector in the perfect position to capture all the frequencies necessary to maintain optimum satellite signal levels.

A technician or a customer can very simply remove the nuts and bolts holding the satellite dish reflector to the mounting bracket of a residential or commercial satellite dish without changing the elevation or azimuth coordinate settings of the satellite dish.

Ease of installation is important. Using the present invention a customer or technician uses for example a felt marker to indicate where the "skew" adjustment is on the skew indicator 28, before removing reflector dish 10 from mounting bracket 30. With mounting bracket 30 thus removed, cover 12 is then placed on the back of the reflector dish 10 so as to snugly fit around the outer edge 10*a*. The heat probe 20 is inserted in direction A into end 22*a* of arm 22. Dish 10 is then re-attached to mounting bracket 30. In particular, bolts 32 are journalled through holes 10*b* on the back of dish 10, and through mounting holes 34*a* in mounting plate 34. The skew adjustment is confirmed and nuts 32*a* then retightened onto bolts 32. The tightening of the nuts 32*a* and bolts 32 that attach the reflector dish 10 to mounting bracket 30 sandwiches the cover 12 thereby securing it in place; cover 12 having a note cover 12*a* in it to accommodate the mounting bracket 30. The wiring for heat tape 16 is attached. An electrical cord 26*a* runs from the wiring 26 to an external 110V power source. No adhesive is necessary for installation due to the sandwiching of the cover 12 in place between the mounting bracket 30 and the mounting collar 10*c* on the back of dish 10 and no physical means of the Dishheat system ever moving and falling off.

Installation of the dish heating system of the present invention is straight-forward as there are no adhesives, modifications or special qualifications necessary. As described above, a person simply needs to mark the skew setting, remove dish 10 from the mounting bracket 30, slide the rear cover 12, which has been assembled to include insulation 18 against the inside surface of the cover, and to then layer the heating tape 16, or other heating element or sheet, against the inner surface of the insulation, Dishheat system onto the back of dish 10. Heat probe 20 is then inserted into the end 22*a* of arm 22, the skew re-aligned as per the mark, and the dish 10 reattached and bolted back onto the mounting bracket 30, so as to sandwich the cover 12, insulation 18, and heating tape 16 between collar 10*c* on the back of dish 10 and mounting bracket 30. A thermal sensor and cut-off may be incorporated into the heating element in case of overheating.

The heating element may draw approximately 120 watts, although the actual power consumption may be dictated by the applicable standards such as electrical safety standards and codes such as building codes. Typically the heat tape is self-regulating in terms of maximum power consumption. The power consumption will be sufficient to melt snow and ice on the reflector dish 10 and arm 22. In one embodiment, a timer may be incorporated into the electrical On/Off switch, in case a user forgets to switch the heating element off.

Due to the fact that extreme cold temperatures aversely affect adhesives, they quite often do not adhere properly at such temperatures. As well, moisture from the build-up of snow and ice on the face of the dish 10 interferes with adhesives. Because there are no adhesives used in the system of the present invention, it can be installed with basic tools in short order in winter conditions.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. For mounting between:

a) a satellite dish having a concave front surface and an opposite convex rear surface, wherein said rear surface of said dish has a substantially centrally positioned mounting platform extending rearwardly therefrom, said mounting platform having mounting bores therein spaced apart around said platform; and, (b) a mounting bracket for rigidly mounting said dish to a secure mounting location on a roof, house, building, wherein said mounting bracket has at least one mounting face adapted for mounting onto said mounting platform, said at least one mounting face having mounting apertures therein, positioned for mounting registry between said bores and said apertures when said mounting bracket is adjacent said mounting platform so as to accept fasteners journalled through said bores and corresponding said apertures to thereby mount said mounting bracket to said dish, a satellite dish heating system comprising:

a cover having a rim therearound sized to snugly mate onto and around, so as to seal from the exterior environment, a corresponding circumferential outer edge of said dish, said cover when mounted thereon defining an interior cavity, said cover having at least one hole therethrough substantially centrally positioned so that said cover is sandwiched between said mounting platform on said rear surface of said dish and said mounting bracket when mounted onto said mounting platform, said cover having an inner surface in opposed facing relation to said rear surface of said dish when said cover is mounted on said dish, wherein a layer of insulation is mounted within said cavity adjacent said inner surface of said cover, and wherein at least one heating element is mounted within said cavity adjacent said layer of insulation and on an opposite side of said layer of insulation from said inner surface of said cover whereby said at least one heating element is mounted between said layer of insulation and said rear surface of said dish when said cover is mounted of said dish.

2. The system of claim 1 wherein said layer of insulation is mounted against said inner surface of said cover and said heating element is mounted against said layer of insulation.

3. The system of claim 2 wherein said cover is sized so that with said layer of insulation and said heating element mounted within said cover, said cavity includes an air-space between said heating element and said rear surface of said dish.

4. The system of claim 2 wherein said heating element includes at least one heating tape.

5. The system of claim 1 wherein said layer of insulation includes a reflective layer which is reflective of thermal radiation.

6. The system of claim 5 wherein said layer of insulation includes insulating material and wherein said reflective layer is positioned between said heating element and said insulating material, and wherein said system further comprises a heat conductive plate mounted adjacent said heating element so as to be between said rear surface of said dish and said heating element when said cover is mounted on said dish.

7. The system of claim 1 wherein said mounting platform is substantially a collar, and wherein said at least one hole in said cover includes a central hole substantially corresponding in size and position to said collar, and wherein said central hole is slightly smaller in diameter as compared to a diameter of said collar and as compared to a corresponding diameter of said mounting face on said mounting bracket, whereby a circumferential rim of said central hole is pinched between said mounting platform and said mounting face.

8. The system of claim 1 wherein said layer of insulation and said heating element extends within said cover between and substantially to opposite sides of said rim, and wherein said system further comprises a heat conductive plate mounted adjacent said heating element so as to be between said rear surface of said dish and said heating element when said cover is mounted on said dish.

9. A method for heating a satellite dish comprising:

(a) providing a satellite dish having a concave front surface and an opposite convex rear surface, wherein said rear surface of said dish has a substantially centrally positioned mounting platform extending rearwardly therefrom, said mounting platform having mounting bores therein spaced apart around said platform; and, (b) providing a mounting bracket for rigidly mounting said dish to a secure mounting location on a roof, house, building, wherein said mounting bracket has at least one mounting face adapted for mounting onto said mounting platform, said at least one mounting face having mounting apertures therein, positioned for mounting registry between said bores and said apertures when said mounting bracket is adjacent said mounting platform so as to accept fasteners journalled through said bores and corresponding said apertures to thereby mount said mounting bracket to said dish, (c) providing a cover having a rim therearound sized to snugly mate onto and around, so as to seal from the exterior environment, a corresponding circumferential outer edge of said dish, said cover when mounted thereon defining an interior cavity, said cover having at least one hole therethrough which is substantially centrally positioned on said cover, (d) mounting said cover onto said dish so as to snugly mount said rim of said cover around said cover and so as to align said mounting platform within said at least one hole in said cover, (e) mounting said mounting face of said mounting bracket onto said mounting platform on said rear surface of said dish so as to pinch-mount said cover in a friction mounting therebetween.

10. The method of claim 9 wherein said cover has an inner surface in opposed facing relation to said rear surface of said dish when said cover is mounted on said dish, and further providing a layer of insulation mounted within said cavity adjacent said inner surface of said cover, and wherein at least one heating element is mounted within said cavity adjacent said layer of insulation and on an opposite side of said layer of insulation from said inner surface of said cover whereby said at least one heating element is mounted between said layer of insulation and said rear surface of said dish.

11. The method of claim 10 wherein said layer of insulation is mounted against said inner surface of said cover and said heating element is mounted against said layer of insulation.

12. The method of claim 11 wherein said cover is sized so that with said layer of insulation and said heating element mounted within said cover, said cavity includes an air-space between said heating element and said rear surface of said dish.

13. The method of claim 10 wherein said heating element includes at least one heating tape.

14. The method of claim 10 wherein said layer of insulation includes a reflective layer which is reflective of thermal radiation.

15. The method of claim 14 wherein said layer of insulation includes insulating material and wherein said reflective layer is positioned between said heating element and said insulating material, and wherein said system further comprises a heat conductive plate mounted adjacent said heating element so as to be between said rear surface of said dish and said heating element when said cover is mounted on said dish.

16. The method of claim 9 wherein said mounting platform is substantially a collar, and wherein said at least one hole in said cover includes a central hole substantially corresponding in size and position to said collar, and wherein said central hole is slightly smaller in diameter as compared to a diameter of said collar and as compared to a corresponding diameter of said mounting face on said mounting bracket, whereby a circumferential rim of said central hole is pinched between said mounting platform and said mounting face.

17. The method of claim 10 wherein said layer of insulation and said heating element extends within said cover between and substantially to opposite sides of said rim, and wherein said system further comprises a heat conductive plate mounted adjacent said heating element so as to be between said rear surface of said dish and said heating element when said cover is mounted on said dish.

* * * * *